US010299599B2

(12) United States Patent
Browning et al.

(10) Patent No.: US 10,299,599 B2
(45) Date of Patent: May 28, 2019

(54) COLLAPSIBLE SWIVEL CHAIR

(71) Applicant: Chama Chairs Holdings, LLC, Dallas, TX (US)

(72) Inventors: Reagan Browning, Fort Worth, TX (US); Alex Cammack, Fort Worth, TX (US); Cory Emerson, Dallas, TX (US)

(73) Assignee: Chama Chairs Holdings LLC, Dallas, TX (US)

( * ) Notice: Subject to any disclaimer, the term of this patent is extended or adjusted under 35 U.S.C. 154(b) by 0 days.

(21) Appl. No.: 15/661,895

(22) Filed: Jul. 27, 2017

(65) Prior Publication Data

US 2019/0029429 A1 Jan. 31, 2019

(51) Int. Cl.
*A47C 3/18* (2006.01)
*A47C 4/28* (2006.01)
*A47C 4/50* (2006.01)

(52) U.S. Cl.
CPC ..... *A47C 3/18* (2013.01); *A47C 4/286* (2013.01); *A47C 4/50* (2013.01)

(58) Field of Classification Search
CPC .. A47C 3/18; A47C 4/286; A47C 4/50; A47C 4/48; A47C 4/44
USPC ..... 297/344.22, 344.21, 344.1, 16.2, 258.1
See application file for complete search history.

(56) References Cited

U.S. PATENT DOCUMENTS

| | | | | |
|---|---|---|---|---|
| 517,929 | A * | 4/1894 | March | A47C 9/00 297/461 |
| 4,266,748 | A | 5/1981 | Dalton | |
| 8,272,684 | B2 | 9/2012 | Obolewicz et al. | |
| 8,979,184 | B2 | 3/2015 | Stafford | |
| 2002/0117878 | A1 | 8/2002 | Fox | |
| 2003/0020312 | A1* | 1/2003 | Wang | A47C 3/34 297/344.18 |
| 2009/0174233 | A1* | 7/2009 | Hoffman | A47C 4/286 297/16.2 |
| 2010/0314926 | A1 | 12/2010 | Chesness | |

* cited by examiner

*Primary Examiner* — Mark R Wendell
(74) *Attorney, Agent, or Firm* — Dossey & Jones PLLC; Phillip Black; James P. Dossey

(57) ABSTRACT

A chair including a swivel assembly. The chair can include three or more arms pivotally connected to the swivel assembly and selectively moveable between an open position and closed position. The chair can also an arm lock disposed on top of the swivel assembly, where the arm lock is selectively moveable between a locked position and unlocked position. The chair can also include a seat removably connected to a distal end of each arm.

18 Claims, 13 Drawing Sheets

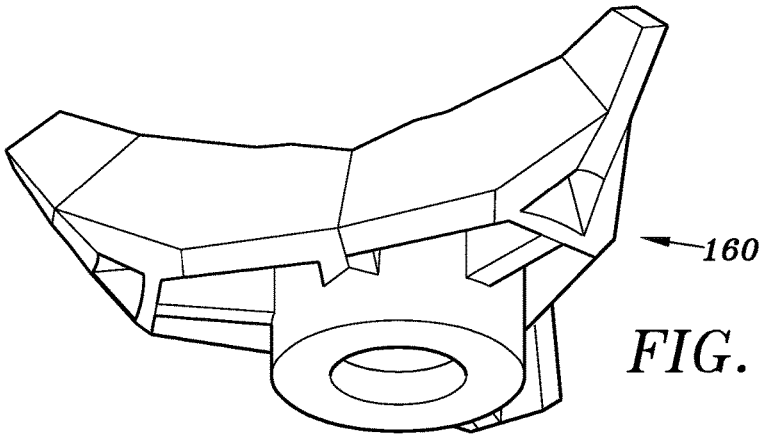
FIG. 8
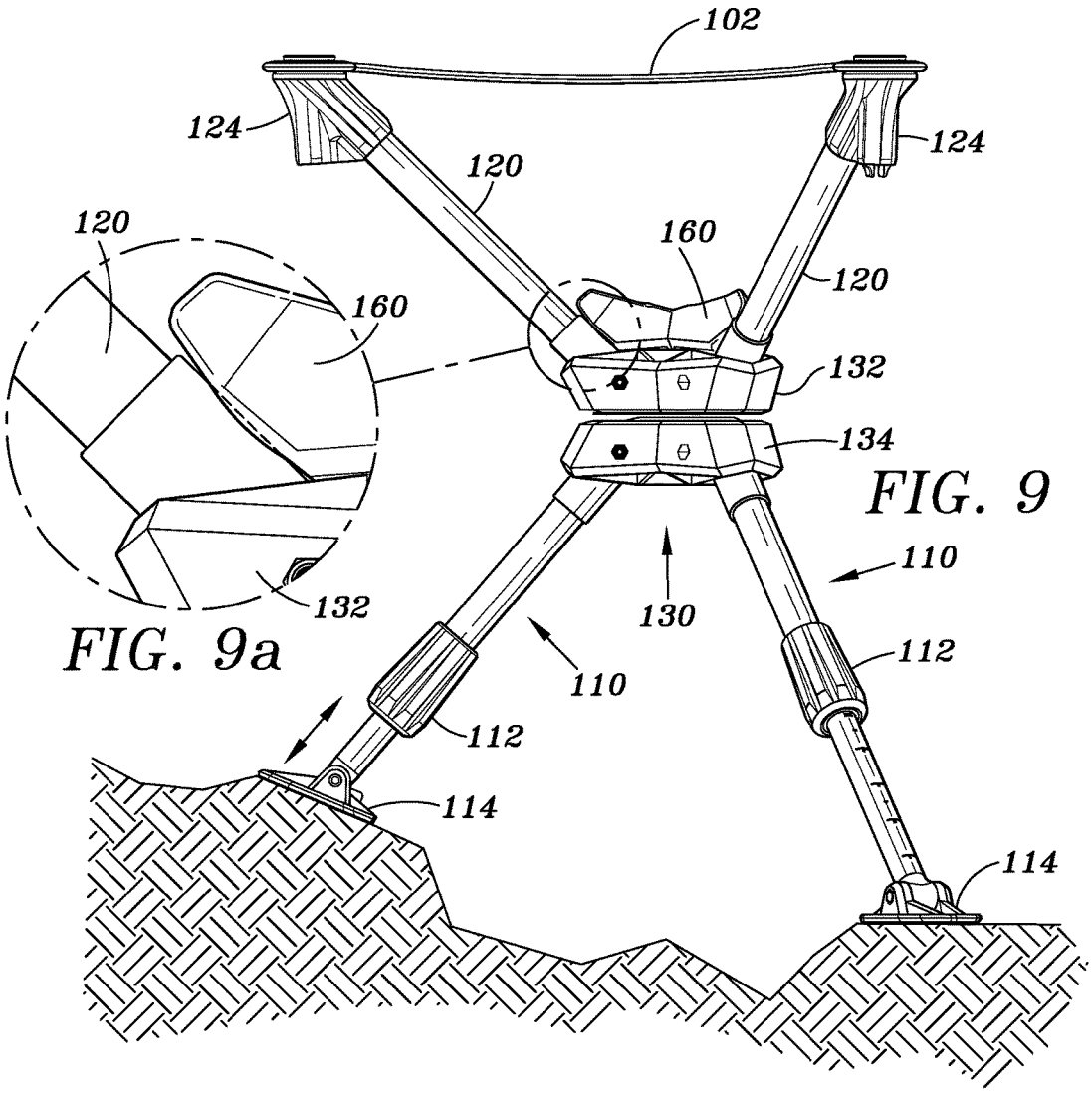
FIG. 9
FIG. 9a

COLLAPSIBLE SWIVEL CHAIR

BACKGROUND OF INVENTION

Field of the Invention

This invention relates to chairs. More particularly, this invention relates to collapsible all-terrain seating.

Description of Related Art

In recent years, lightweight and personalized seating has become popular for outdoor enthusiasts and sports fans alike. With the development of lightweight durable material, folding chairs are more easily carried by a user to and from outdoor seating areas. In essence, the lightweight collapsible chair has provided greater seating mobility. However, this conventional folding chair has its limits and is not well suited to provide comfortable seating when placed on uneven terrains and does not provide the user the ability to turn from side to side once seated in the chair, rather, the user's body is set in a forward-facing direction and the user must turn their head or get up and reposition the chair to change their direction of sight. In addition, the conventional folding chair is not functional for hunters or other sportsmen who are seated in the chair for sporting activities—which can include gun or bow hunting, fishing, and bird watching—because they cannot turn quickly and quietly to face the target. A need exists for an all-terrain collapsible chair that allows the user to quickly and quietly swivel to face the desired target.

SUMMARY OF THE INVENTION

The following is a summary to introduce selected concepts of the invention but is not intended to limit the scope of the invention in any way.

The chair includes a seat, legs, and a swivel assembly. The leg assembly can include arms, legs, and the swivel assembly disposed therebetween. A foot may be pivotally or rotationally affixed to the distal end of each leg, and the foot can be configured to adjust to uneven ground surfaces while providing stability to the chair. Each leg may be extendable and may include a leg lock to secure the leg in an elected extended position so that the seat provides a level seating surface to the user despite an unlevel ground surface. The chair can also include the swivel assembly, having a lower swivel hub and an upper swivel hub. The swivel assembly allows the seat to rotate about the central axis of the chair and independently of the legs. The swivel assembly provides several advantages to the user, including the ability to swivel silently to face a new direction. The al ins are pivotally connected to the upper swivel assembly and can be locked by way of an arm lock mechanism, which will keep the arms in an "open" position so that the chair does not collapse when a user sits on the seat. The lower swivel hub, upper swivel hub, and arm lock can be collectively referred to as the "swivel mechanism." A receiver joint can be connected to the distal end of each arm. The seating surface can be removably connected to the receiver joints to provide a comfortable seat for any user. A seat back assembly can be connected to the chair by inserting seat posts into the receiver joints. One or more accessories can be connected to the chair by clipping into a receiver joint or clipping onto the seat posts.

Other features and advantages of the present invention will become apparent from the following more detailed description, taken in conjunction with the accompanying drawings, which illustrate, by way of example, the principles of the presently described apparatus and method of uses.

BRIEF DESCRIPTION OF THE SEVERAL VIEWS OF THE DRAWING(S)

The accompanying drawings illustrate various exemplary implementations and are part of the specification. The illustrated implementations are proffered for purpose of example, not for purpose of limitation.

Illustrated elements will be designated by numbers. Once designated, an element will be identified by the identical number throughout. Illustrated in the accompanying drawings is at least one of the best mode embodiments of the present disclosure.

FIG. 8 depicts a side view of the arm lock, as shown and described herein.

FIG. 9 depicts a side view of the chair set on an unlevel surface, as shown and described herein.

FIG. 9*a* depicts a close up view of the arm lock in the locked position, as shown and described herein.

Figure 10A:
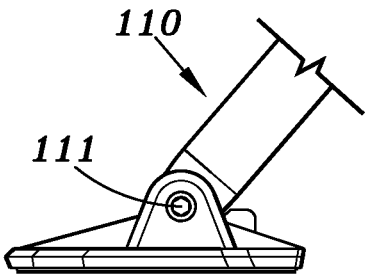

FIG. 10*a* depicts a side view of a foot, as shown and described herein.

Figure 10B:
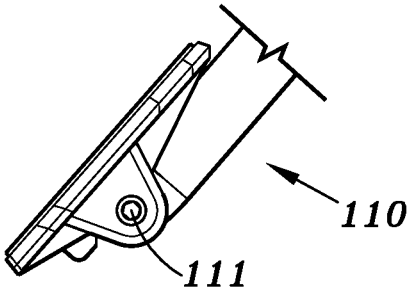

FIG. 10*b* depicts another side view of a foot, as shown and described herein.

Figure 11:
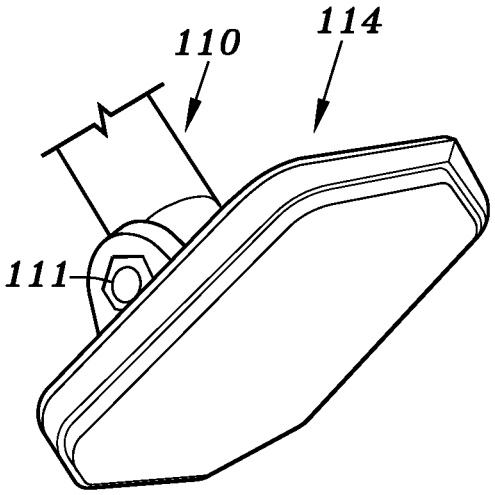

FIG. 11 depicts a bottom view of a foot, as shown and described herein.

Figure 12:
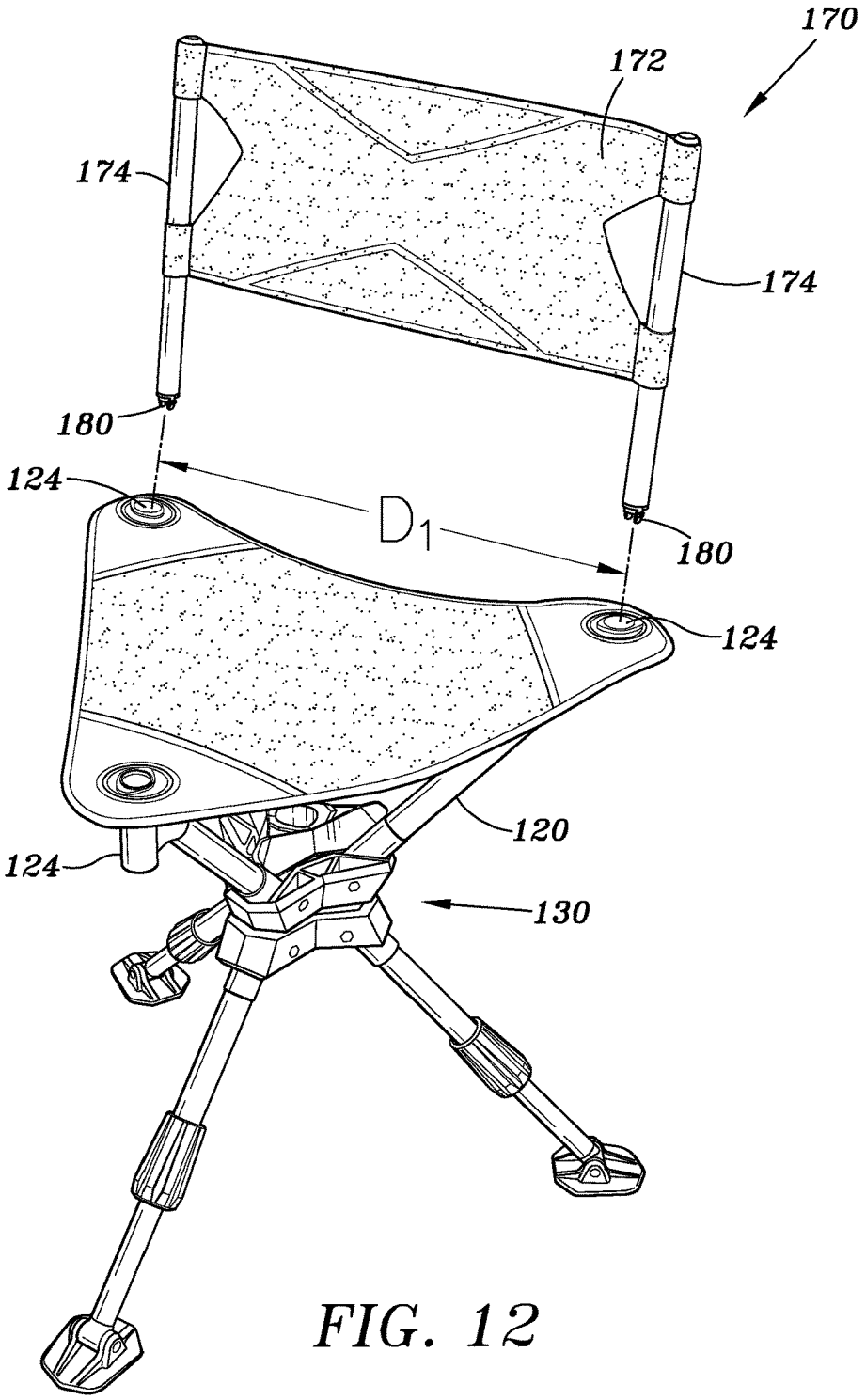

FIG. 12 depicts a perspective view of the chair and insertion of the seat back assembly, as shown and described herein.

Figure 13:
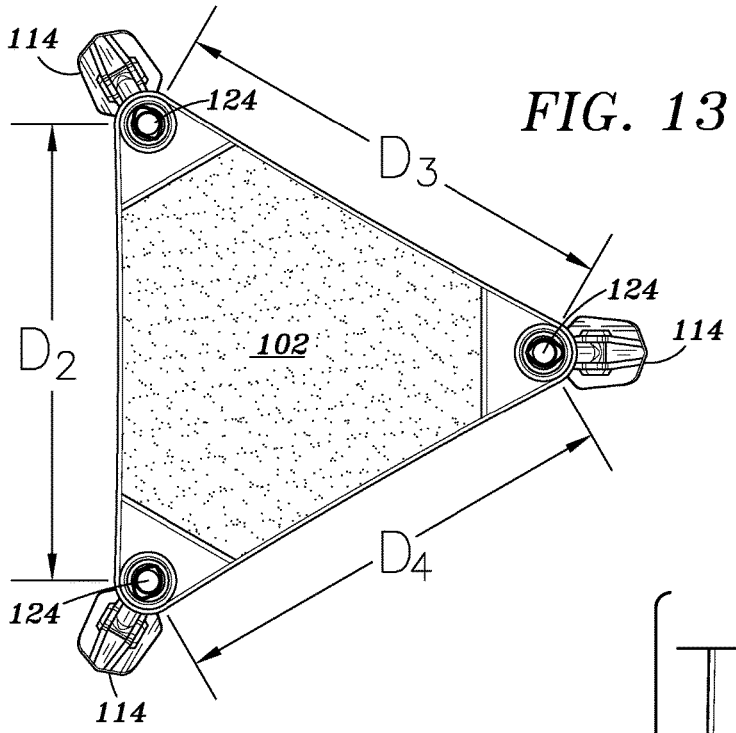

FIG. 13 depicts a top-side view of the chair, as shown and described herein.

Figure 14:
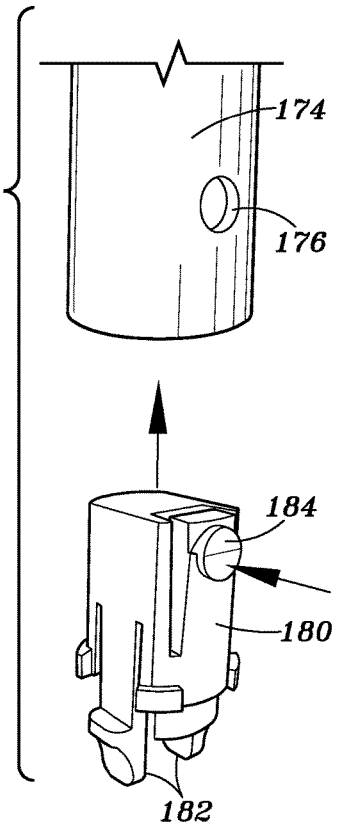

FIG. 14 depicts a side view of the seat post and seat post clip, as shown and described herein.

Figure 15:
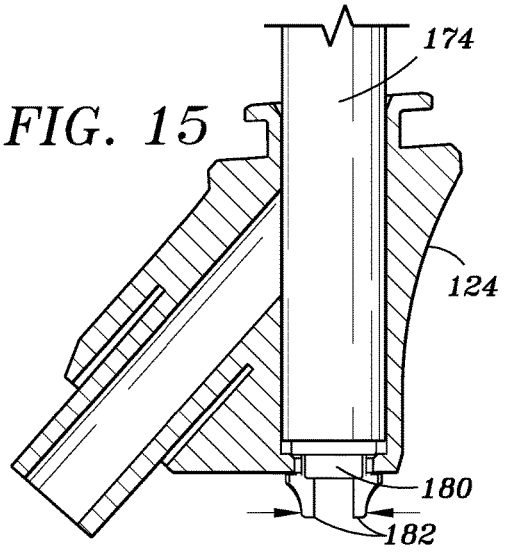

FIG. 15 depicts a cross sectional view of a receiver joint, as shown and described herein.

Figure 16:
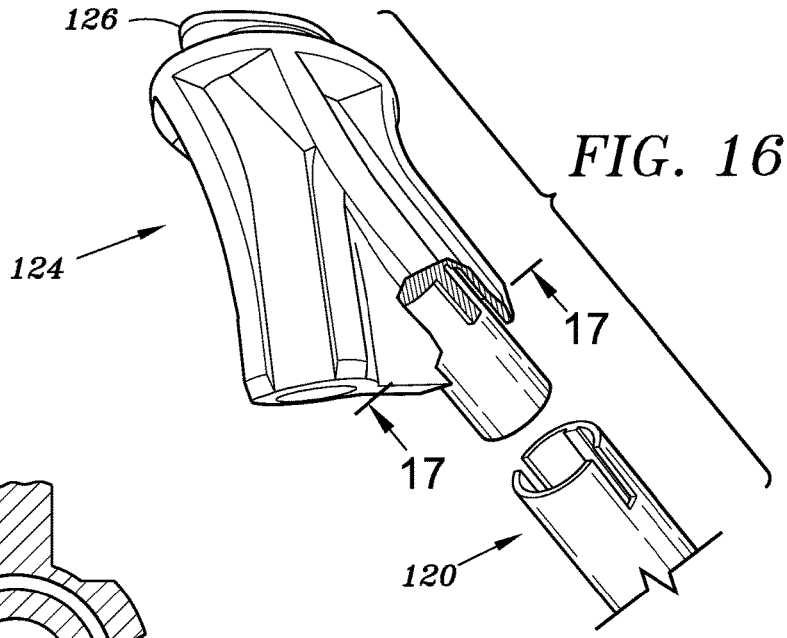

FIG. 16 depicts a side view of a receiver joint identifying the arm connection, as shown and described herein.

Figure 17:
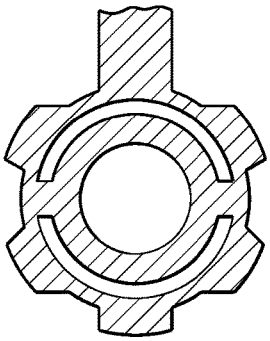

FIG. 17 depicts a cross sectional view of the arm connection of a receiver joint, as shown and described herein.

Figure 18A:
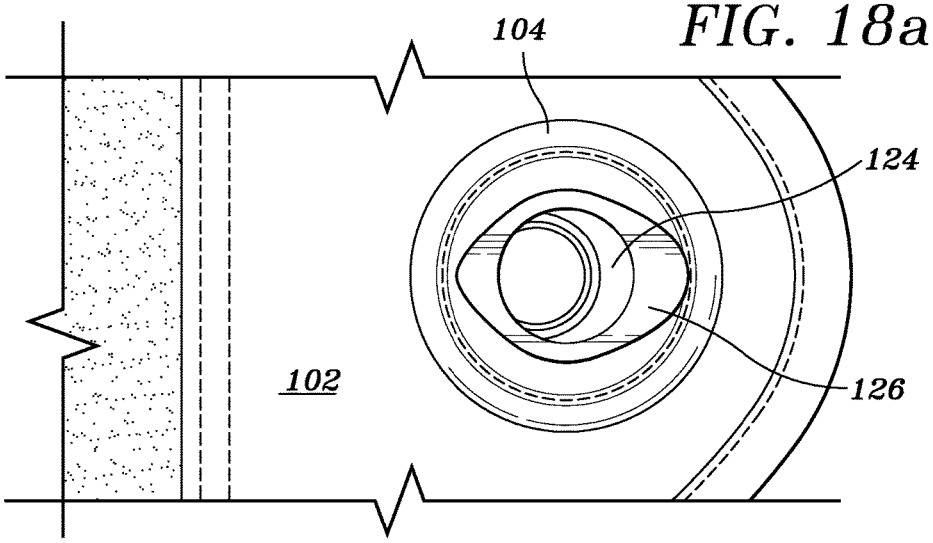

FIG. 18*a* depicts a top-side view of a portion of the seat displaced on the receiver joint, as shown and described herein.

Figure 18B:
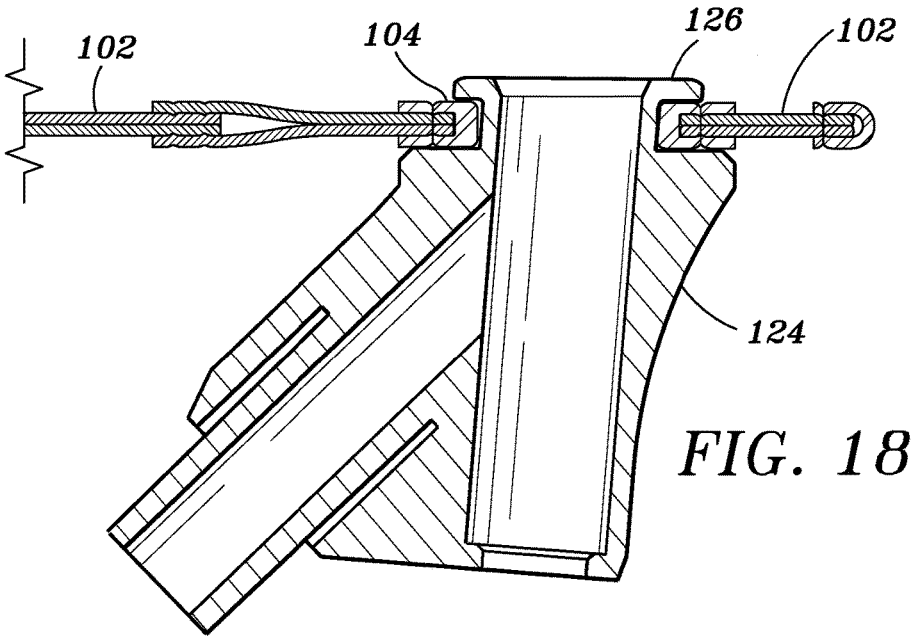

FIG. 18*b* depicts a cross sectional view of the seat secured to the receiver joint, as shown and described herein.

Figure 18C:
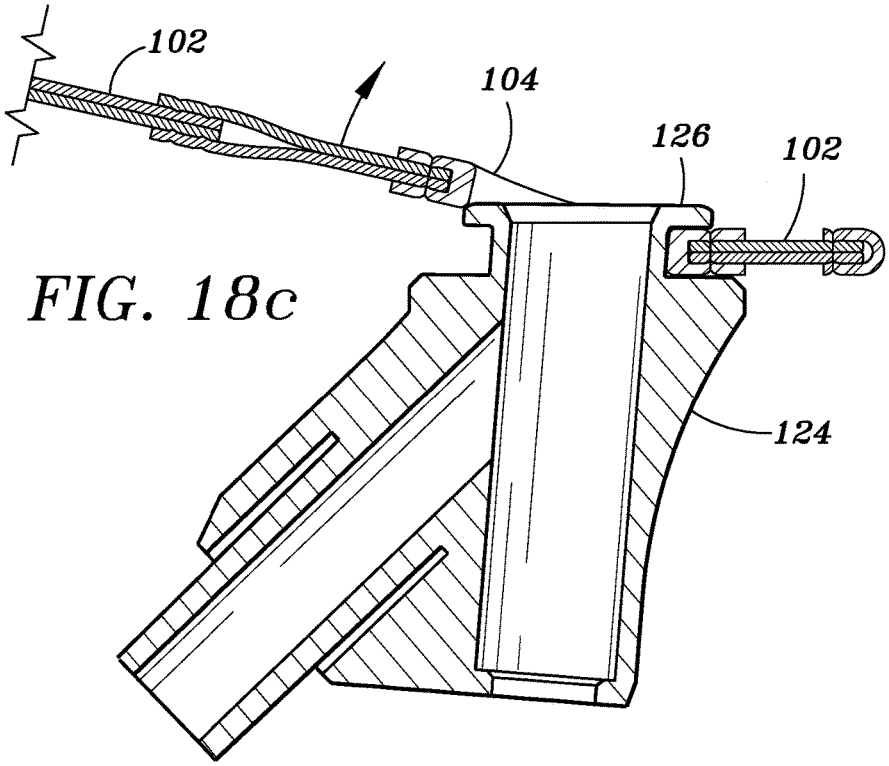

FIG. 18*c* depicts a cross sectional view of the seat removal from receiver joint, as shown and described herein.

Figure 19:
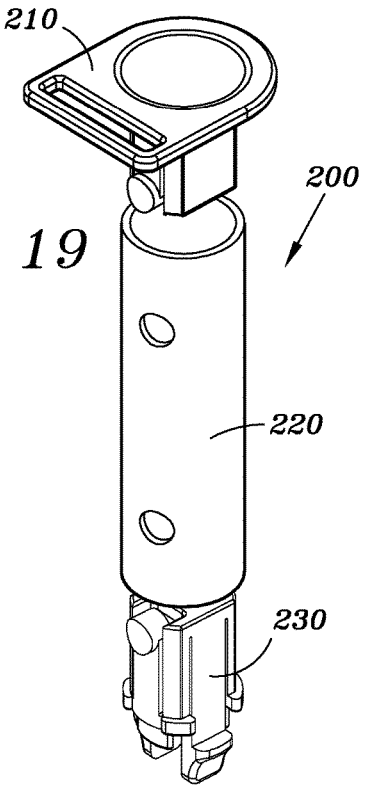

FIG. 19 depicts a side view of the accessory attachment assembly, as shown and described herein.

Figure 20:
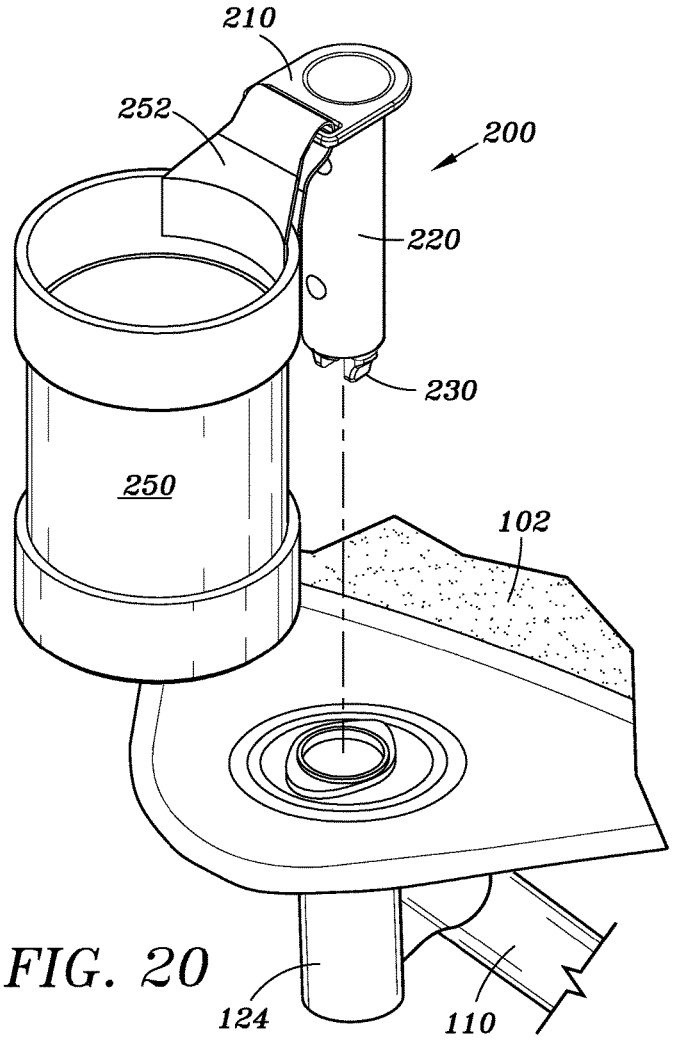

FIG. 20 depicts a side view of the accessory attachment assembly and accessory attaching to the chair, as shown and described herein.

Figure 21A:
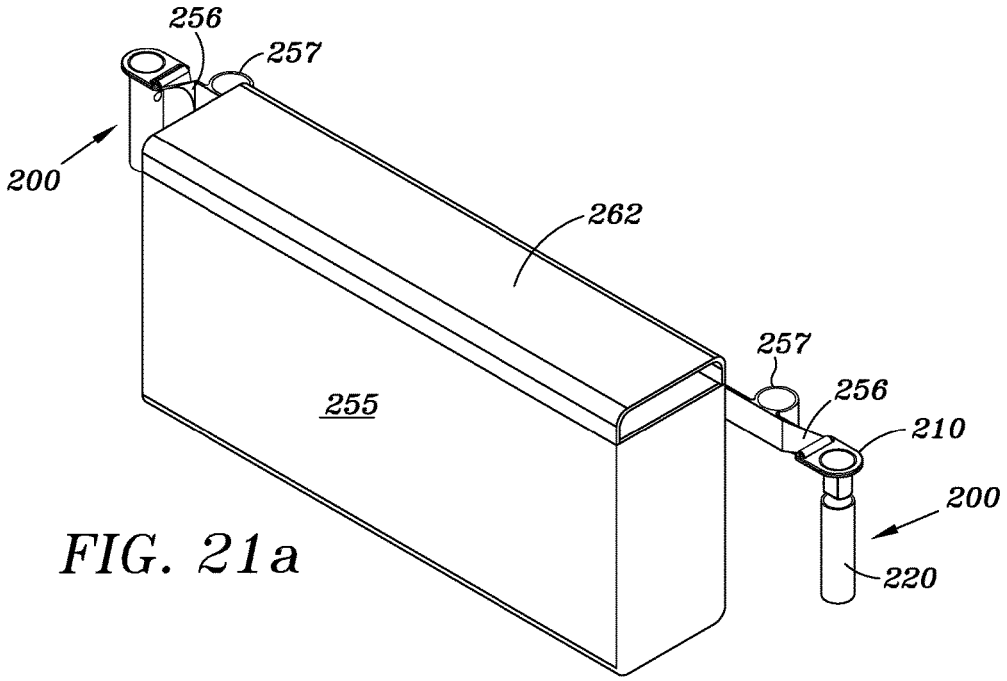

FIG. 21*a* depicts a perspective view of an alternative accessory and accessory attachments, as shown and described herein.

Figure 21C:
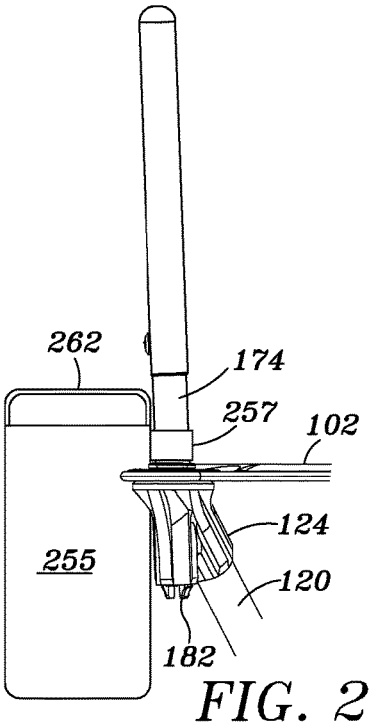
Figure 21B:
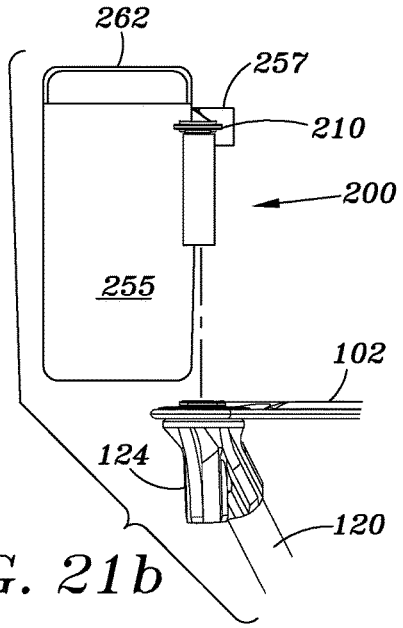

FIG. 21*b* depicts a side view the alternative accessory positioned for connecting to the chair, as shown and described herein.

FIG. 21*c* depicts a side view of the alternative accessory connected to the chair, as shown and described herein.

DETAILED DESCRIPTION OF THE INVENTION

The collapsible swivel chair will be more fully understood and appreciated by reading the following Detailed Description in conjunction with the accompanying drawings, wherein like reference numerals refer to like components.

In various embodiments of the chair described herein, the chair is collapsible, swivels, is easily portable, and is designed to provide sturdy seating surface for a user even when the ground surface is uneven and/or soft. The chair can be collapsed for easier transportation from one located to another. This can be accomplished by several methods, including a carrying strap connected to the chair or inserting the chair into a bag or case specifically designed for portability. The chair can be expanded, or "opened", from the collapsed configuration into a seating configuration, providing a seating surface for a user.

Figure 1:
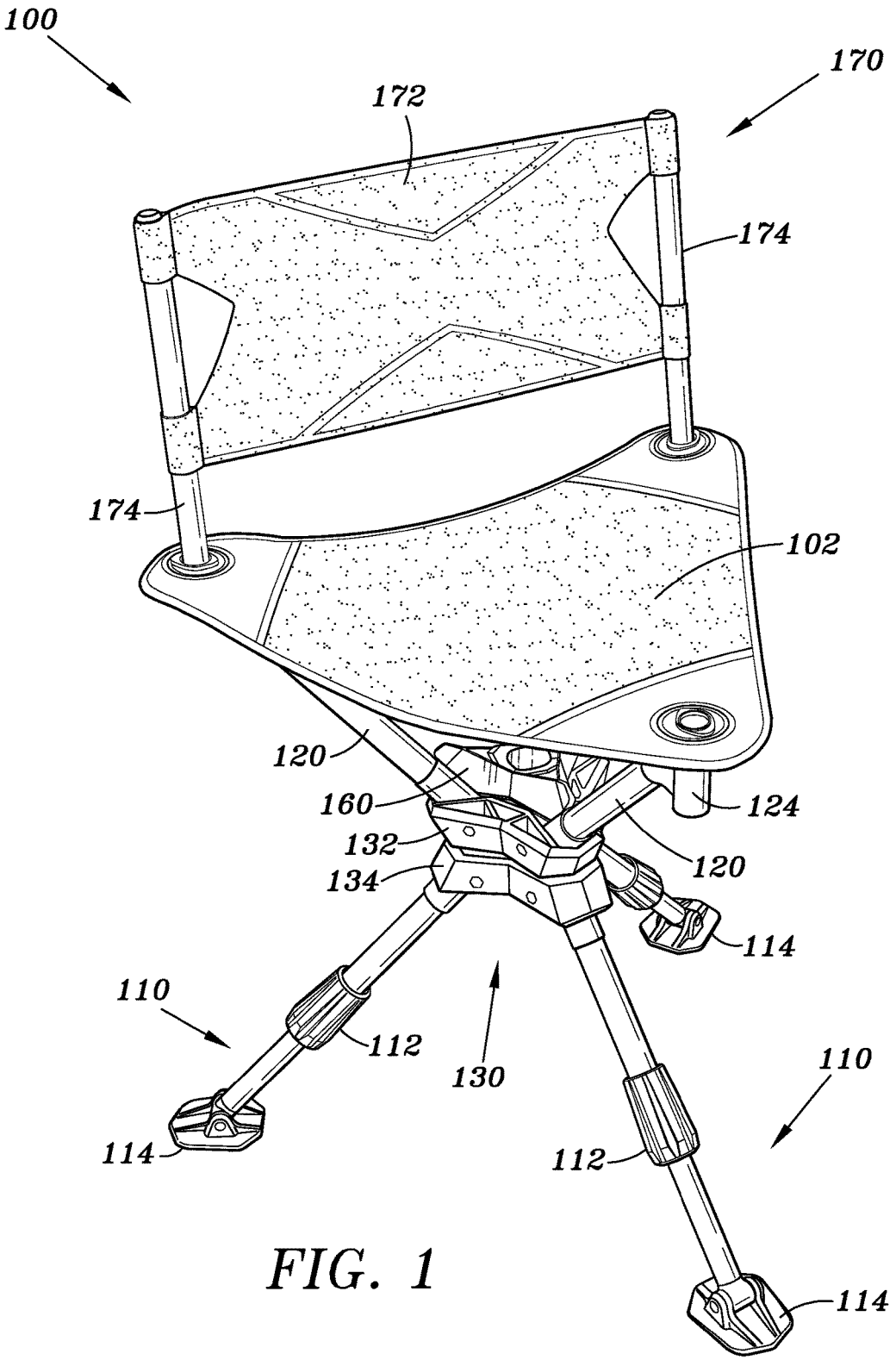
FIG. 1 depicts an isometric view of the chair in an open, or non-collapsed, configuration, as discussed and described herein.

FIG. 1 depicts an isometric view of the chair 100 in an open configuration. The chair 100 can include a seat 102 and a support assembly. The support assembly can include one or more legs 110, one or more arms 120, a swivel assembly 130, and an arm lock 160. The legs 110 of the chair 100 can be extendable and secured at a selected length by the leg lock 112. A foot 114 can be pivotally or rotationally connected to the distal end of one or more of the legs 110. The chair can also include a seat back assembly 170 to provide back support to a user seated on the seat 102 of the chair 100. The seat back assembly can include a back rest 172 positioned to accommodate a user's back by attachment to one or more seat posts 174.

The swivel assembly 130 can include an upper swivel hub 132 and a lower swivel hub 134, and the swivel assembly 130 can be designed so that the upper swivel hub 132 can swivel, or rotate, independent of the lower swivel hub 134. The proximal end of each leg 110 can be pivotally connected to the lower swivel hub 134 and the proximal end of each arm 120 can be pivotally connected to the upper swivel hub 132. Accordingly, when the chair is in the open position and is placed on the ground, the upper swivel hub 132 and all chair components above it may swivel about the central axis of the chair in relation to the lower swivel hub 134 and the legs 110 therefrom.

The distal end of each arm 120 can be connected to a receiver joint 124. As depicted herein, the chair can include three or more arms 120, and the number of arms can directly relate to the shape of the seat 102. As shown, three arms 120 can provide adequate support to a triangular seat 102 by connecting, via the receiver joint 124, the distal end of each arm 120 to a corresponding corner of the seat 102. In such an arrangement, the arms 120 can provide sufficient support to the chair 100 when in use.

Figure 2:
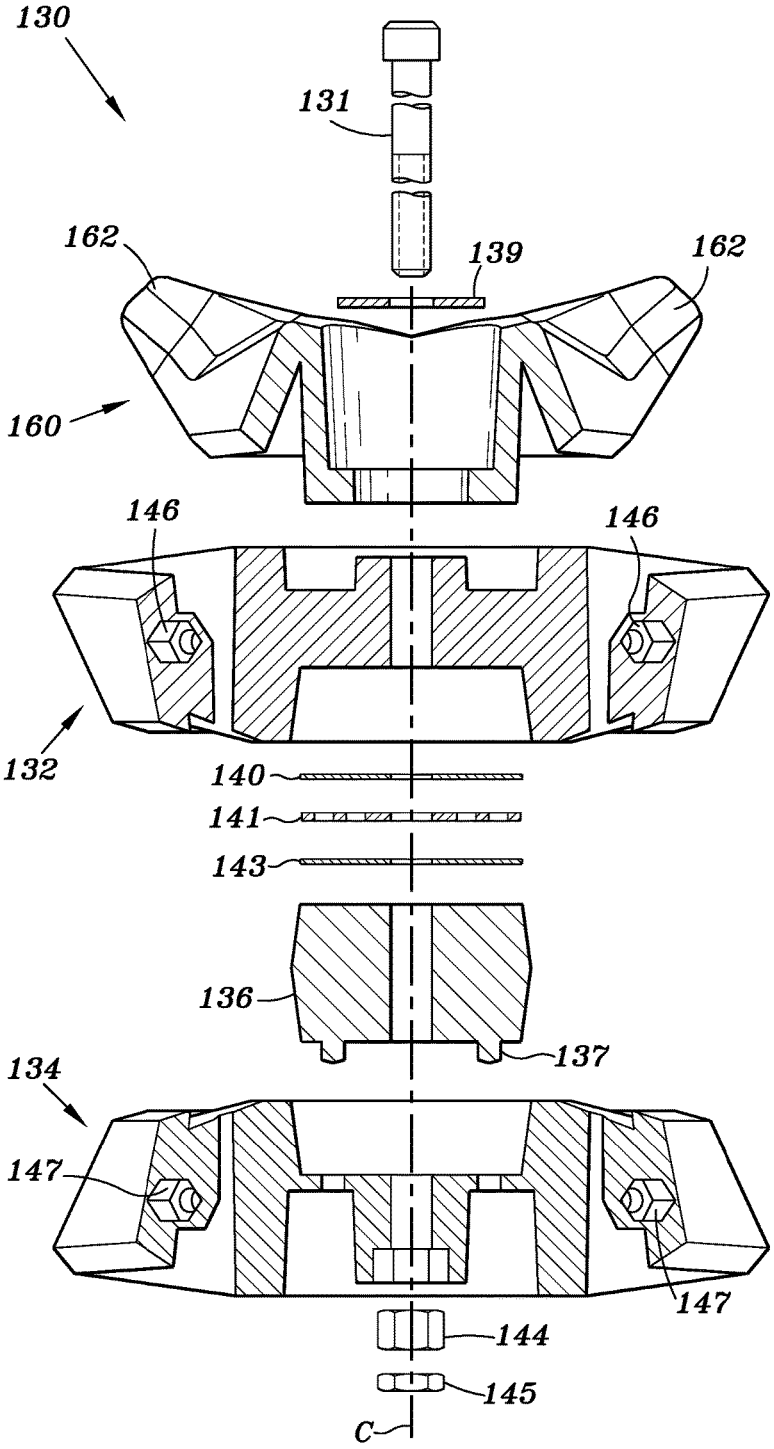
FIG. 2 depicts a cross-sectional, exploded view of the swivel assembly and the arch lock, as discussed and described herein.
Figure 3:
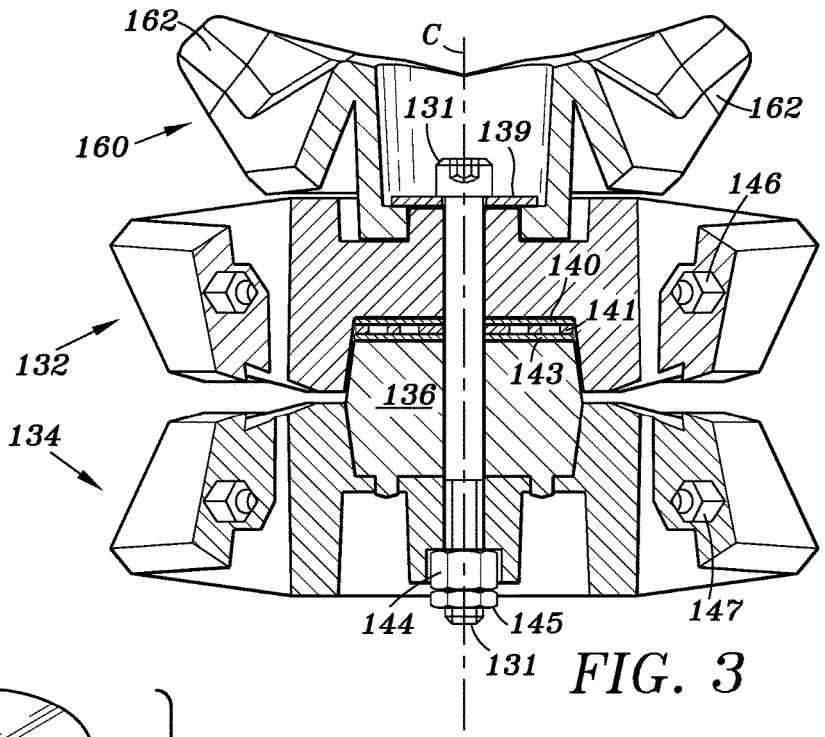
FIG. 3 depicts a cross-sectional assembled view of the swivel assembly and the arm lock, as shown and described herein.

FIG. 2 is a cross-sectional, exploded view of the swivel assembly 130 and the arm lock 160. FIG. 3 is a cross-sectional assembled view of the swivel assembly 130 and the arm lock 160. The swivel assembly can include the upper swivel hub 132 and the lower swivel hub 134, and swivel capable component(s) disposed therebetween so that the hubs rotate about a central axis C in relation to one another. In one or more embodiments, the swivel assembly 130 and arm lock 160 can include a bolt 131, a first flat washer 139, the arm lock 160, the upper swivel hub 132, a second flat washer 140, a thrust bearing washer 141, a third flat washer 143, an internal block. 136, the lower swivel hub 134, a first nut 144, a second nut 145, or a combination thereof. The swivel components disposed between the hubs 132, 134 can include the internal block 136, the one or more flat washers 140, 143, one or more of the thrust bearing washers 141, or any combination thereof.

The thrust bearing washer can be a self-lubricating thrust bearing washer and can be made of brass, aluminum, aluminum alloy, steel, copper, or another common metal or alloy used in the production of hardware. In an alternative embodiment, the thrust bearing washer 141 can be made of plastic, including any polymer sufficient to provide the necessary function.

The internal block 136 can include one or more flanges 137 (two are shown) to prevent the internal block 136 from rotating in relation to the lower swivel hub 134. Each flange 137 can be aligned with a hole or void in the lower swivel hub 134 to prevent lateral and/or rotational movement of the internal block 136.

One or more of the components of the swivel assembly and arm lock can have a channel or hole through its center so that, when assembled, these holes line up to form the central axis C. The arm lock 160 can have a ring mount configured to fit into an arm lock cavity disposed about the top surface of the upper swivel hub 132. The upper swivel hub 132 can also have a cavity, or "upper block cavity," disposed about its bottom surface configured to receive at least a first portion of the swivel components. The lower swivel huh 134 can have a corresponding cavity, or "lower block cavity," disposed about its top surface and configured to receive at least a second portion of the swivel components.

Figure 4:
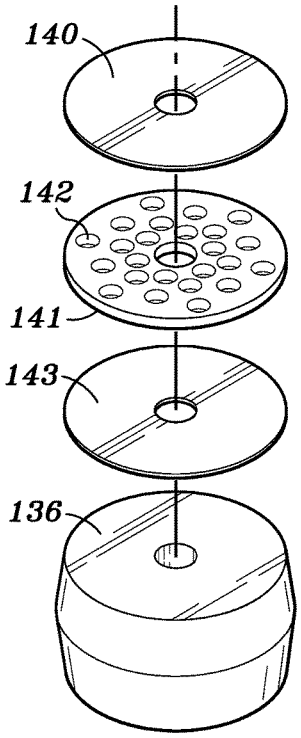
FIG. 4 depicts a perspective side view of the swivel components, as shown and described herein.

FIG. 4 is a perspective side view of the swivel components. In one or more embodiments, the swivel components can be arranged as shown, a flat washer 140 positioned on top of the thrust bearing washer 141, and the thrust bearing washer 141 positioned on top of another flat washer 143. The washers 140, 141, 143 can then be positioned on the top surface of the internal block 136. A lubricant (i.e., grease) can be applied to the thrust bearing washer 141. Once lubricated, the thrust bearing washer 141 will remain lubricated.

The internal block 136 can then be positioned within the lower block cavity of the lower swivel hub 134 in such a way that the internal block 136 does not rotate in relation to the lower swivel hub 134.

Once assembled, as shown in FIG. 3, the bolt 131 can be disposed through the central axis to secure the swivel assembly 130 and arm lock 160 in the assembled arrangement. As shown, the bolt can be disposed downward through the swivel assembly 130 and arm lock 160 and secured at the bottom of the lower swivel hub 134 by a first nut 144 and, optionally, a second nut 145 In one or more embodiments, a locking solution can be applied to the first and/or second nut 144, 145. Optionally, an additional flat washer (one is shown, 139) can be disposed about the top surface of the arm lock 160.

The upper swivel hub 132 can include one or more arm connectors 146 for connecting each arm 120 to the upper swivel hub 132. Similarly, the lower swivel hub 134 can include one or more leg connectors 147 for connecting each leg 110 to the lower swivel hub 134.

Figure 5:
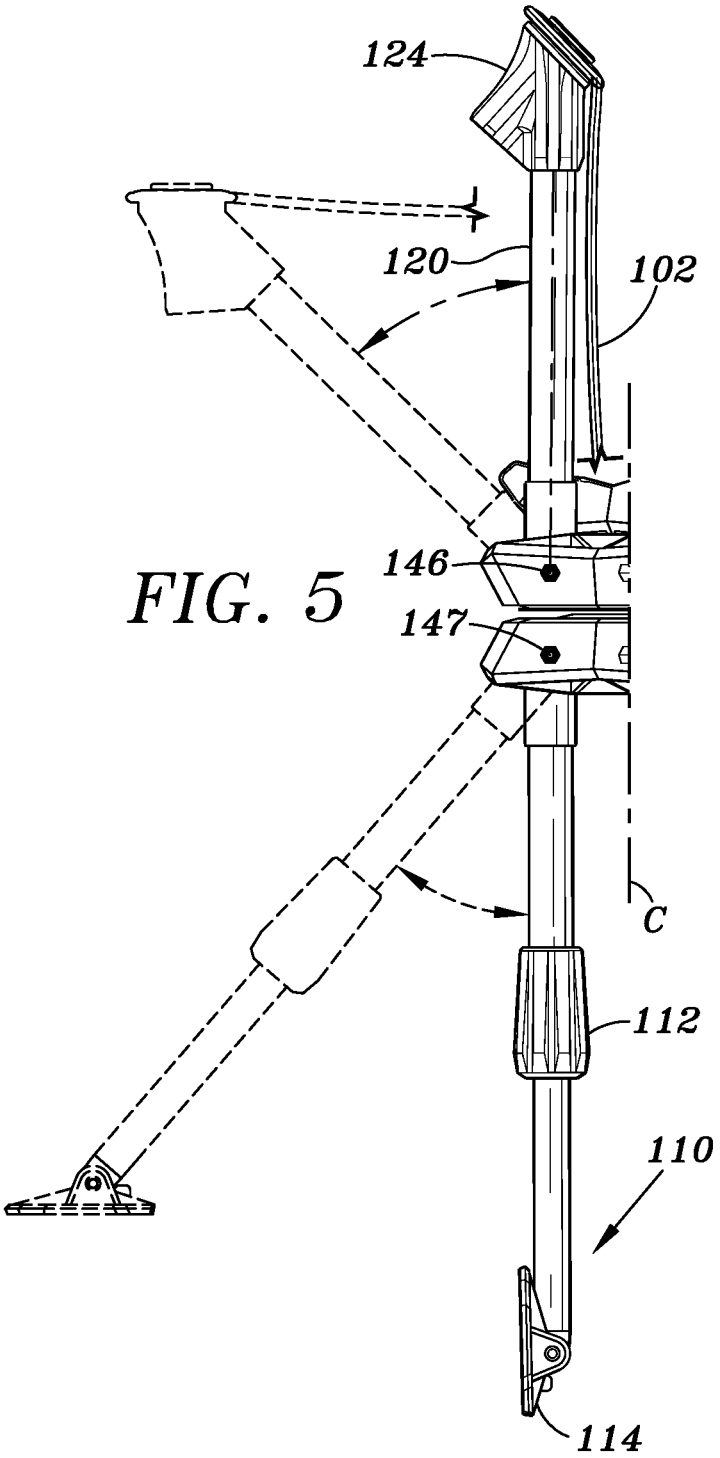
FIG. 5 depicts a side view of a portion of the chair showing the collapsed and open positions, as shown and described herein.

The chair can be collapsed by folding the arms 120 and legs 110 in toward the central axis C. FIG. 5 depicts a side view of a portion of the chair showing the collapsed position (solid lines) and open position (broken lines). Each leg 110 and each arm 120 can be moved to the collapsed position by simply moving the leg 110 toward the central axis C of the chair.

The proximal end of each arm 120 can be connected to the upper swivel hub 132 at the arm connector 146 and configured to rotate or pivot about a connection point. As show, the arm connector 146 can include a bolt disposed through a hole in the proximal end of the arm 120 and secured to the upper swivel hub 132 by securing the bolt with a nut. As such, the bolt serves as a connection point about which each arm 120 rotates when moving from the open to closed position, and vice versa. The legs 110 can be connected to the lower swivel hub 134 in the same or similar manner via leg connectors 147, such that the bolt disposed through the proximal end of each leg allows the leg 110 to move from the open to closed position, and vice versa. In one or more embodiments, a connection cap or end piece can be disposed on the proximal end of one or more of the arms 120 and/or legs 110 to provide more durability and stability to the respective connection points.

Figure 6:
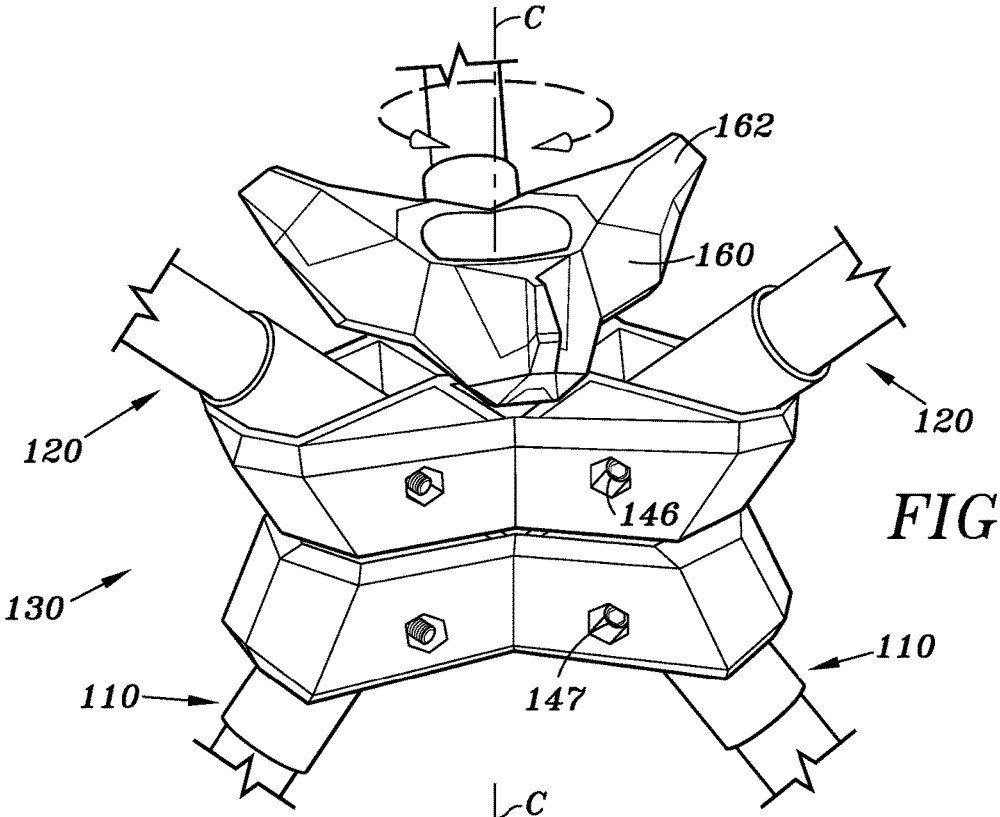
FIG. 6 depicts a view of the swivel mechanism and arm lock positioned in the unlocked position, as shown and described herein.

The arms 120 can be collectively locked into the open position or collectively unlocked by rotating the arm lock 160. FIG. 6 shows the arm lock 160 in the "unlocked" position. When the arm lock 160 is in the unlocked position, the arms 120 can each pivot about the arm connectors 146. This makes it easy for a user to collapse the chair by folding the arms 120 toward the central axis C, as shown in FIG. 5.

Figure 7:
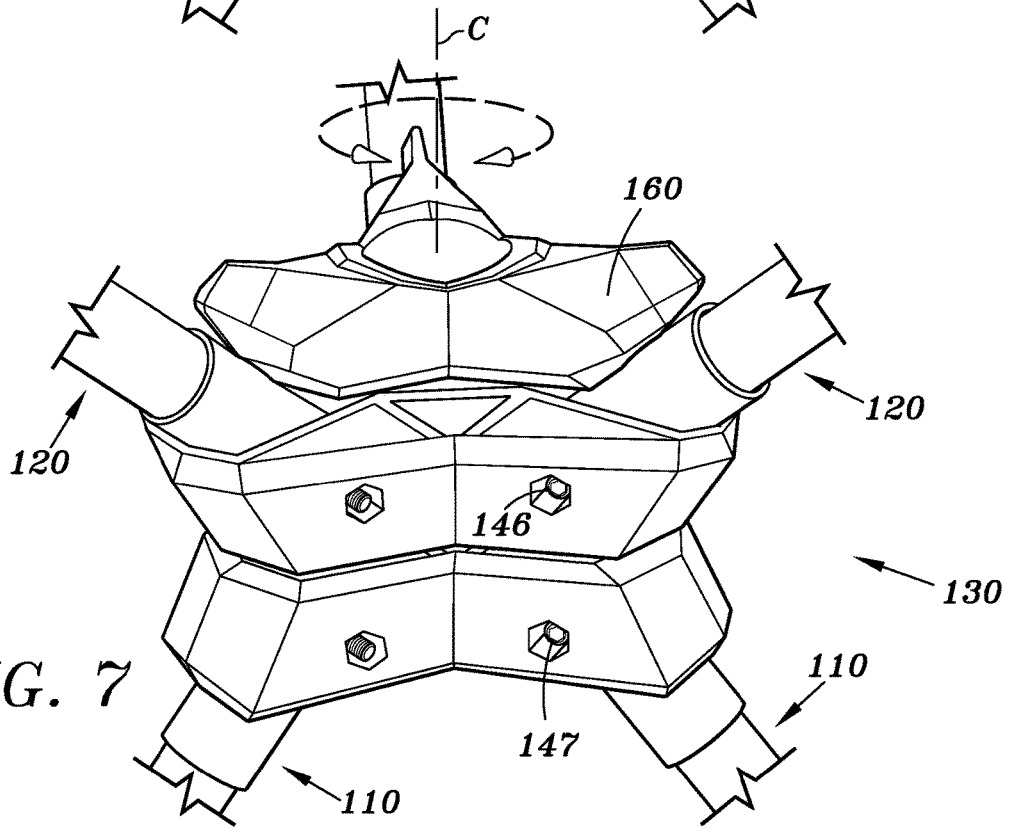
FIG. 7 depicts a view of the swivel mechanism and arm lock positioned in the locked position, as shown and described herein.

However, when the arm lock 160 is moved to the "locked" position, as shown in FIG. 7, the arms 120 are secured in the open position and cannot be collapsed toward the central axis C. This is exceptionally beneficial to a user sitting on the seat 102. When weight is disposed on the seat 102 a downward force naturally causes the center of the seat to move downward, thereby collapsing the legs 110 toward the center axis C of the chair. This collapsing of the arms 120 creates an ineffective and uncomfortable seating surface not capable of supporting the user. However, when the arm lock 160 locks the arms 120 open, the seat 102 will not collapse.

FIG. 8 depicts a bottom perspective view of the arm lock. 160. As shown, the arm lock 160 can include three wings, though in other embodiments the number of wings can change to match the number of arms. In the locked position, each wing aligns with a corresponding arm 120 and secures that arm 120 in the open position. Each wing can include a turning grip 162 to allow the user to better grip the arm lock 160 to turn it to the desired position.

FIG. 9 depicts a side view of the chair set on unlevel ground. The chair is shown in the open position, and FIG. 9*a* provides a closeup view of the arm lock 160 engaging the arm 120 to prevent the arm 120 from moving inward and, inevitably, collapsing from any weight placed on the seat 102.

In order to level the seat 102 of the chair on an unlevel or uneven surface, the length of one or more of the legs 110 can be adjustable. Each leg 110 can include an outer tubular member and an inner tubular member, and the diameter of the outer tubular member can be larger than the diameter of the inner tubular member such that the outer and inner tubular members can adjust the length of the leg 110 telescopically. A leg lock 112 can lock the tubular members of a leg 110 to establish a desired length of the leg 110. The leg lock 112 can fix the axial position of the inner tubular member relative to the outer tubular member. The leg lock 112 can be rotated axially to tighten, secure, or lock, the leg 110 at a desired length. The leg lock 112 can rotated in the opposite axial direction to unlock the tubular members of the leg 110, allowing the length of the leg 110 to be extended or reduced.

Each leg 110 can also include a foot 114. As shown in FIGS. 10*a* and 10*b*, the foot 114 can be pivotally connected to the distal end of each leg 110. The foot 114 can pivot about a connection joint 111 to further adapt the chair to uneven ground. The user may desire to completely fold in each foot to further reduce the diameter of the collapsed chair, as shown in FIGS. 5 and 10*b*. In an alternative embodiment, the foot 114 can be rotationally connected (i.e., ball-and-joint) to the distal end of the leg 110. Referring to FIG. 11, the foot can provide a wide contact surface to reduce the likelihood that the leg 110 will stick or be otherwise negatively affected by soft ground.

As shown in FIG. 12, the seat back assembly 170 can be removable from the chair. One or more seat post clips 180 can be disposed about the bottom of each seat post 174 and configured to connect to the receiver joints 124 of the chair. The seat back 172 can be appropriately sized so that, once connected to the seat posts 174, the seat posts 174 are the proper distance $D_1$ apart so that they provide a taught and supportive seat back for a person seated in the chair.

As shown in FIG. 13, the components of the chair can be configured in an equilateral triangular embodiment so that the length between the first and second $D_1$, second and third $D_2$, and third and first $D_3$ receiver joints 124 is equidistant, or about equidistant. The symmetric design provides stability to the chair while allow the user to sit and face any direction comfortably.

As shown in FIG. 14, a seat post clip 180 can be connected to a bottom end of each seat post 174. The seat post clip 180 can have a button 184 that is mechanically and/or outwardly biased (i.e., spring loaded) so that the button 184 will engage a hole 176 disposed in the seat post 174, to secure the seat post clip 180 to the seat post 174. One or more wing clips 182 can extend from the seat post clip 180. The wing clips 182 can be spring loaded and configured to attach the seat post 174 and seat post clip 180 combination to the receiver joint 124.

The receiver joint 124 is configured to attach to at least the arms 120, the seat posts 174, the seat 102, or a combination thereof. FIG. 15 depicts a cross sectional view of a receiver joint 124 with the seat post 174 and seat post clip 180 combination disposed therein. The seat post can be sized and oriented so that the seat post can slide downward into a seat post receiving channel within the receiver joint 124. The seat post 174 can slide into the seat post receiving channel until the wing clips 182 "clips" the seat post 174 into position.

The receiver joint 124 also attaches to the distal end of each arm 120 via an arm receiving channel. FIG. 16 depicts a side view of the receiver joint 124 slidably connected to the distal end of the arm 120. One or more ridges can extend from the arm receiving channel and from the arm 120 to provide a secure attachment and to prevent axial rotation of the arm 120 in relation to the receiver joint 124. FIG. 17 depicts a cross sectional view of the arm connection of a receiver joint.

The seat 102 can be configured to connect to the one or more receiver joints 124. In one or more embodiments, as shown in FIGS. 18*a*, 18*b*, and 18*c*, the seat 102 can have a hole disposed through the seat 102 at each corner and configured to removably attach to a receiver joint 124. FIG. 18*a* depicts a top-side view of a portion of the seat 102 disposed on the receiver joint 124. The seat 102 can include an attachment ring 104 configured to attach to the receiver joint 124. The receiver joint 124 can include a rim or lip 126 configured to attach to the attachment ring 104 of the seat 102. The lip 126 can be located at the top of the receiver joint 124 and can generally extend around the circumference of seat post receiving channel. The lip 126 can have a thin portion and a broad portion, and the thin portion can be disposed toward the inside of the seat 102. In an alternative embodiment, the seat 102 can be connected to the top of the receiver joint 124 by other attachment means.

FIG. 18*b* depicts a cross sectional view of the seat 102 disposed on the receiver joint 124. As shown, the attachment ring 104 can include a stretchable material configured to fit over a rim or lip 126 of the receiver joint 124. To remove the seat 102 from the chair, a user can pull the seat 102 so that the attachment ring 104 slips over the thin portion of the lip 126 first, then pull the seat 102 upward to slip the attachment ring 124 over the thick portion of the lip 126.

One or more accessories can be connected to the chair. FIG. 19 depicts a side view of the accessory attachment assembly 200. The accessory attachment assembly 200 can include an accessory receiver 210, an attachment tube 220, an attachment clip 230, or a combination thereof. The accessory attachment assembly 200 can also include an accessory strap slot. The accessory receiver 210 can be configured to attach to the top terminus of the attachment tube 220 and the attachment clip 230 can be configured to attach to the bottom terminus of the attachment tube 220. The accessory receiver 210 and the attachment clip 230 can each have an outwardly biased (i.e., spring loaded) button configured to be disposed through a hole in the attachment tube 220. In an alternative embodiment, the accessory receiver 210 and the attachment clip 230 can be connected to the attachment tube 220 by another attachment means, including: glue, male and female threading, etc. As shown in FIG. 20, an accessory 250 (a cup holder is shown) can be connected to the accessory attachment assembly by a strap 252 disposed through the accessory strap slot. The accessory attachment 200 assembly can be inserted into the leg post channel of the receiver joint 124 of the seat.

One or more alternative attachments may require more support, and need to be connected to the chair at two contact points. FIG. 21*a* depicts a perspective view of an alternative attachment 255. This alternative attachment 255 can be connected to two accessory attachment assemblies 200, one at each end, via an alternative support strap 256 and can include one or more support loops 257. The support loops can be configured to attach to the seat posts 174. The alternative attachment can include a lid 162.

FIG. 21*b* depicts a side view the alternative accessory 255 positioned for connecting to the chair. In this alternative embodiment, the accessory attachment assembly 200 can occupy the same receiver joints 124 as the seat posts 174 of the seat back assembly. To do so, the attachment clip can be absent from the accessory attachment assembly 200. With the accessory attachment assembly 200 inserted into two of the receiver joints, the seat back assembly can then be connected to the chair by inserting the seat posts 174 through the attachment tube 220 disposed in the receiver joint 124. The seat post clips 182 can then "clip," or otherwise secure, the seat posts 174 and accessory assembly into place. FIG. 21*c* depicts a side view of the alternative accessory connected to the chair.

Although the present invention has been described with respect to specific details, it is not intended that such details be regarded as limitations on the scope of the invention, except to the extent that they are included in the accompanying claims. It will thus be appreciated that those skilled in the art will be able to devise numerous alternative arrangements that, while not shown or described herein, embody the principles of the invention and thus are within its spirit and scope.

We claim:

1. A swivel assembly, comprising:

a lower swivel hub having three or more legs pivotally connected thereto;

an upper swivel hub having three or more arms pivotally connected thereto; and an arm lock seated on the upper swivel hub wherein a central axis of the arm lock aligns with a central axis of the swivel assembly and wherein the arm lock is selectively movable between a locked position and an unlocked position by rotation about its central axis.

2. The swivel assembly of claim 1, wherein each arm is selectively moveable between an open position and a closed position and wherein the movement of one of the arms does not result in the movement of the other arms.

3. The swivel assembly of claim 2, wherein when the arm lock is in the locked position, the arms are secured in the open position.

4. The swivel assembly of claim 1, further comprising a receiver joint disposed on the distal end of each arm, wherein a hole having a lip is disposed in each corner of a removable seat, and wherein the seat is removably connected to a corresponding receiver joint.

5. The swivel assembly of claim 1, further comprising an internal block connecting the lower swivel hub to the upper swivel hub.

6. The swivel assembly of claim 1, wherein the lower swivel hub comprises a lower block cavity about its top surface, wherein the upper swivel hub comprises an upper block cavity about its bottom surface, and wherein a swivel block and one or more washers are disposed within the lower block cavity and the upper block cavity.

7. The swivel assembly of claim 6, wherein an elongated member is disposed through the lower swivel hub, swivel block, one or more washers, upper swivel hub, and arm lock, forming the central axis of the swivel assembly.

8. The swivel assembly of claim 6, wherein the one or more washers comprises a flat washer, a first thrust bearing washer, and a second thrust bearing washer.

9. The swivel assembly of claim 1, wherein the arm lock rotates independently of the upper swivel hub to lock and unlock the three or more arms into an open position.

10. A swivel chair, comprising:

a swivel assembly comprising an upper swivel hub and a lower swivel hub;

three or more arms pivotally connected to the upper swivel hub and selectively moveable between an open position and closed position;

an arm lock seated in an arm lock cavity disposed about the top surface of the upper swivel hub, wherein the arm lock is selectively moveable between a locked position and unlocked position by rotation about a central axis;

three or more legs pivotally connected to the lower swivel hub; and a seat removably connected about a distal end of each arm.

11. The swivel chair of claim 10, further comprising a receiver joint connected to the distal end of each arm.

12. The swivel chair of claim 11, further comprising a plurality of attachment rings disposed through the seat, wherein each of the attachment rings are removably attachable to a corresponding receiver joint.

13. The swivel chair of claim 12, further comprising a seat back assembly comprising a plurality of seat posts removably connected to a corresponding receiver joint.

14. The swivel chair of claim 11, wherein the seat is removably connected to the distal end of each arm at the receiver joint.

15. The swivel chair of claim 11, further comprising a seat back, wherein the seat back comprises two seat posts, wherein each seat post comprises a seat post clip about its bottom end, and wherein the seat post is removably disposed in a seat post receiving channel of the receiver joint.

16. A swivel chair, comprising:

a swivel assembly comprising an upper swivel hub operably connected to a lower swivel hub, such that the upper swivel hub rotates relative to the lower swivel hub;

three or more legs pivotally connected to the lower swivel hub, each arm selectively moveable between an open position and a closed position;

three or more arms pivotally connected to the upper swivel hub, each arm selectively moveable between an open position and a closed position;

a receiver joint disposed on a distal end of each arm, a seat having three or more corners, each corner removably connected to a lip of a corresponding receiver joint; and an arm lock seated in an arm lock cavity disposed about the top surface of the upper swivel hub, wherein the arm lock is selectively moveable between a locked and an unlocked position by rotation about a central axis.

17. The swivel chair of claim 16, wherein the lower swivel hub comprises a lower block cavity about its top surface, wherein the upper swivel hub comprises an upper block cavity about its bottom surface, and wherein a swivel block and one or more washers are disposed within the lower block cavity and the upper block cavity.

18. The swivel chair of claim 17, wherein a bolt forms the central axis of the swivel assembly and wherein the bolt is disposed through the lower swivel hub, the swivel lock, the one or more washers, the upper swivel hub, and the arm lock.

* * * * *